United States Patent [19]

Osborne

[11] Patent Number: 4,748,717

[45] Date of Patent: Jun. 7, 1988

[54] HINGE

[75] Inventor: David Osborne, Mt. Dandenong, Australia

[73] Assignee: Highland Bond Pty. Ltd., Victoria, Australia

[21] Appl. No.: 917,963

[22] Filed: Oct. 14, 1986

[30] Foreign Application Priority Data

Oct. 18, 1985 [AU] Australia ..... PH02962

[51] Int. Cl.[4] ..... E05D 7/04; E05D 5/00; E05D 5/12

[52] U.S. Cl. ..... 16/240; 16/241; 16/243; 16/245; 16/354; 16/380; 16/382

[58] Field of Search ..... 16/240, 241, 243, 245, 16/354, 380, 382; 256/26

[56] References Cited

U.S. PATENT DOCUMENTS

| | | | |
|---|---|---|---|
| 1,433,379 | 10/1922 | Kiesel, Jr. | 16/386 |
| 1,484,536 | 2/1924 | Way | 16/242 |
| 1,900,081 | 3/1933 | Swerer | 16/242 |
| 1,908,383 | 5/1933 | Vice | 16/242 |
| 4,381,580 | 5/1983 | Hellström et al. | 16/243 |

FOREIGN PATENT DOCUMENTS

| | | | |
|---|---|---|---|
| 137937 | 7/1950 | Australia . | |
| 237164 | 12/1959 | Australia . | |
| 500277 | 11/1975 | Australia . | |
| 2254978 | 12/1973 | France . | |
| 265451 | 3/1950 | Switzerland | 16/243 |
| 357301 | 11/1961 | Switzerland | 16/382 |
| 676661 | 6/1952 | United Kingdom . | |
| 1336046 | 11/1973 | United Kingdom . | |
| 2070680 | 9/1981 | United Kingdom . | |

*Primary Examiner*—Nicholas P. Godici
*Assistant Examiner*—Edward A. Brown
*Attorney, Agent, or Firm*—Price, Heneveld, Cooper, DeWitt & Litton

[57] ABSTRACT

A hinge is disclosed which has a barrel 12 which is screw threaded at least at its ends. A grub screw 16 is inserted into one end of the barrel and can be screwed into and out of the barrel to adjust the relative height of a pin 22 inserted into the barrel to enable the height of a gate to be adjusted. The hinge can be used as a left or right hand hinge by simply inverting the hinge and screwing the grub screw 16 into the appropriate end of the hinge. An intermediate element 70 may be included to adjust for misalignment of the gates. The intermediate element has an eccentric bore 73 and the element can be rotated within the barrel 12 and locked to the pin 22 to adjust the pivot point of the pin 22 in the barrel 12 and thereby adjust for any misalignment of the hinge.

9 Claims, 3 Drawing Sheets

38
39
46

18
16
20

18
16

12

12
52
50
38
14
10
A
B
18
16
C
D
20
24
12
22
60
25
30
12
32
32
14

12

14

HINGE

HINGE

This invention relates to a hinge for suspending gates, doors and the like.

Hinges for suspending relatively heavy gates or doors are well known and generally comprise a barrel portion which is closed at one end and which receives a ball-bearing adjacent to the closed end. The ball-bearing is retained in place by a clip. The barrel may be directly coupled to the gate or door frame or may include a strap welded to the barrel for coupling the barrel to the gate or the door. The hinge includes a pin with a flat end which is inserted in the open end of the barrel and engages the ball-bearing. The pin is a tight fit in the barrel. The pin has a second portion for connecting the pin to a post or other article from which the gate or door is to be suspended.

Conventional hinges suffer from a number of drawbacks. Firstly in mounting a gate or door with conventional hinges fine tolerances are required in order to enable the gate or door to open smoothly. Hence, much care is needed when mounting the gate on the hinges. If one of the hinge components is slightly out of line it is extremely difficult to mount the gate since the barrel part of the hinge must be correctly aligned with the pin part of the hinge so that the pin can be inserted into the barrel and can rest on the ball-bearing. If the components are slightly out of line the barrel and pin will jam before the pin seats on the ball-bearing or if the pin is able to seat on the ball-bearing the hinge will bind when the gate or door is opened.

Another major disadvantage with conventional hinges is that the hinge is not adjustable. Accordingly, if it is required to raise or lower the height of the gate it is necessary to remove the hinge from the gate and to relocate it at the desired position on the gate. Alternatively the pin can be disconnected from its post and relocated at the desired position on the post.

Furthermore, conventional hinges are either left or right hand hinges. When mounting a gate on a post or the like it is therefore necessary to ensure that the correct hinge is purchased.

The object of this invention is to overcome problems associated with height adjustment of an article suspended by a hinge and the object of the preferred form of the invention is to overcome the other disadvantages discussed above.

The invention may be said to reside in a hinge having a barrel portion, a pin for location in said barrel portion and a pin locating member coupleable to said barrel portion for movement in the longitudinal direction of said barrel portion relative to said barrel portion for locating said pin in the barrel portion so that said pin is able to rotate in said barrel portion, said barrel portion being open at both ends and having an internal screw thread at least at both ends, said pin locating member having a screw threaded surface for engagement with the internal screw thread of said barrel portion, said pin locating member being coupleable to the barrel portion by engaging the screw threaded surface of the pin locating member with said internal screw threaded surface and being movable in said longitudinal direction by being screwed into and outwardly of the barrel portion, said hinge being able to adjust the position of articles with which it is used by screwing the said pin locating member into or outwardly of said barrel portion so that the location of said pin is altered relative to said barrel in the longitudinal direction of the barrel to thereby adjust the relative height of the article to which the pin can be coupled relative to the height of the article to which the barrel is coupled and said pin locating member being screwable into either end of said barrel portion so that the hinge can be used as either a right hand or left hand hinge by screwing the pin locating member into the appropriate end of the barrel and inserting the pin into the other end of the barrel.

Since the hinge of this invention includes a pin locating portion which is movably coupled in said barrel portion, the hinge, after it is mounted to articles such as a post and a gate, can be adjusted by simply moving the pin locating portion relative to the barrel to thereby raise or lower the gate relative to the pin. Since the barrel portion is open at both ends the pin locating portion can be inserted in either end and the pin inserted into the opposite end to engage the pin locating portion thereby enabling a right or left hand hinge to be used. Thus, the pin of the preferred embodiment does not suffer the drawback of being only usable in a left or right hand situation.

The pin may engage the pin locating member by abutting the pin locating member or it may engage a ball bearing or the like disposed between the member and the pin.

The barrel may include a strap portion or may be directly welded to a gate frame. In embodiments where the barrel includes a strap portion the barrel is preferably formed by rolling the end of the strap portion to form the barrel at the end of the strap portion. Accordingly, in this embodiment it is not necessary to weld a barrel onto the strap portion if the strap portion is necessary to mount the barrel.

The pin locating portion may have a concave portion for receiving said pin and preferably the end of the pin is rounded to smoothly locate in said concave portion. Alternatively the pin locating portion could be flat or could have a convex portion which engages the pin to reduce the surface contact between the pin and the pin locating portion to thereby reduce friction.

The provision of a rounded end on the pin enables easy insertion of the pin into the barrel and therefore fine tolerances are not required when aligning pins with their respective barrels. This enables easy mounting of a gate or door as the rounded portion of the pin can easily slide into the barrel even if the pin is not perfectly aligned with the barrel since the rounded portion of the pin will tend to guide the pin into the barrel.

Another problem which hinges suffer from is caused by a misalignment of the gates in a plane perpendicular to the plane containing the gates. In this regard, the gate is not vertical but is inclined slightly with respect to the vertical which means that one hinge is generally not above the other hinge. This type of misalignment is called wind or twist. Furthermore, gates can also drop which means the free end of the gate has been lowered compared to the hinged end of the gate. Conventional hinges do not allow for adjustment of both of these types of misalignment and it is an object of a second aspect of the invention to provide a hinge which can allow for adjustment to compensate for this misalignment.

The invention in a second aspect therefore provides a hinge having a barrel, a pin for location in said barrel said hinge having an adjustment element in said barrel for receiving said pin, said adjustment element being movable relative to said barrel to adjust the location of the pin in the barrel in a direction transverse to the longitudinal axis of the pin and barrel.

A preferred embodiment of the invention will be described in detail with reference to the accompanying drawings in which:

FIG. 1 is a cross-sectional view through a hinge embodying the invention;

Figures 2, 3, 12, 13, 14, 15, 16:
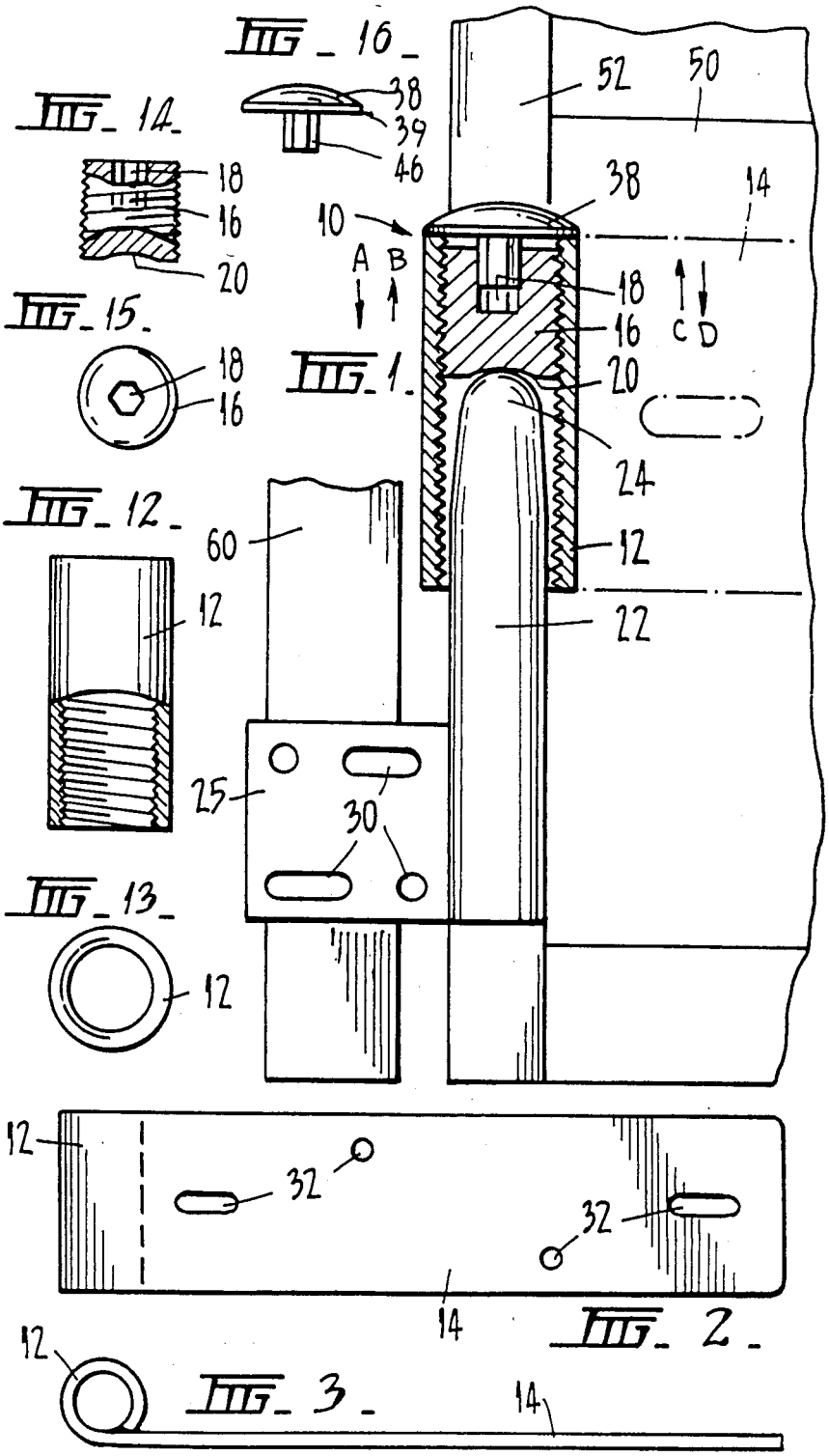
FIG. 2 is a front view of one component of a hinge embodying the invention.
FIG. 3 is a top view of the component of FIG. 2.
FIG. 12 is a view of a component similar to FIG. 2.
FIG. 13 is an end view of the component of FIG. 12.
FIG. 14 is a view of a pin locating portion of the hinge of the preferred embodiment.
FIG. 15 is an end view of the component of FIG. 14.
FIG. 16 is a view of the weather seal.
Figure 4:
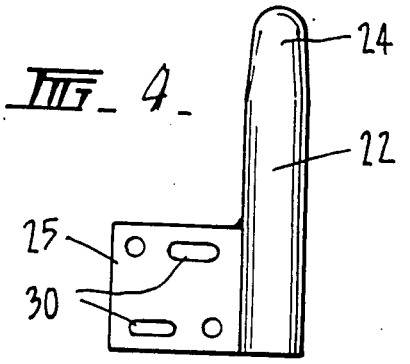
FIG. 4 is a front view of another component of the hinge embodying the invention.

With reference to FIGS. 1 to 4 the hinge 10 comprises a barrel portion 12 which is adapted to be mounted to a gate or door or the like. Barrel portion 10 may include a strap 14 for coupling the barrel 12 to a gate generally indicated by the reference 50. Alternatively the barrel 12 can be directly welded to a frame portion 52 of the gate 50. The barrel 12 is provided with an internal screw thread which preferably extends along the entire internal diameter of the barrel 12. Both ends of the barrel 12 are open. A pin locating portion 16 is provided with a corresponding thread on its outer surface and is screw threaded into the barrel portion 12. The pin locating portion 16 is preferably in the form of a grub screw and is shown in FIG. 14. The grub screw 16 includes a hexagonal recess 18 in one end which can be engaged by a suitable tool for screwing the grub screw 16 into the barrel 12. In other embodiments (not shown) the recess 18 could be a groove for engagement by a screw driver. As best seen in FIG. 1 the grub screw 16 is provided with a concave portion 20 at the end opposite the recess 18 for receiving a head portion 24 of a pin 22. In other embodiments (not shown) the pin 22 could be provided with a flat head and a ball bearing (not shown) could be arranged between the flat head of the pin 22 and the grub screw 16 so that the pin engages the grub screw via the ball bearing. The pin 22 is received in the barrel 12 and includes a strap portion 24 which is connectable to a fence post 60 or the like. As shown in FIG. 1 the pin 22 is a relatively loose fit in the barrel 12.

In order to mount a gate or door the pin 22 is coupled to the fence post 60 or the like by means of strap 24 by locating suitable fasteners such as nails, screws or bolts through openings 30. It should be noted that some of the openings 30 are elongate so that the pin 22 can be moved horizontally after fasteners have been inserted through the openings 30 and before they are tightened to arrange the pin 22 in its desired position. After the pin 22 has been arranged where required the fasteners are tightened and further fasteners are inserted through the other holes 30 to secure the pin 22. The barrel 12 is coupled to the gate by welding it directly to the gate frame 52 in the case of a metal gate or by attaching it to a wooden gate via the strap 14. As best seen in FIG. 2 the strap 14 includes openings 32. Some of the openings 32 are elongate and perform the same function as the elongate openings 30 in the strap 24. Thus the horizontal position of the barrel 12 can be easily adjusted in the case of a wooden gate with which the strap 14 is used. After a plurality of pins 22 have been connected to a post 60 and a corresponding number of barrels 12 have been connected to the gate, the gate is suspended by locating pins 22 in the barrels 12 so that the head 24 of the pin 22 engages the concave portion 20 of the grub screw 16. Since the pin 22 is a relatively loose fit in the barrel 12 the concave portion 20 of the grub screw 16 seats smoothly on the pin head 24 without binding. Thus fine tolerances in the critical alignment of the pin 22 and the barrel 12 are not required.

In order to adjust the height of the gate the grub screws 16 are merely threaded further into the barrel 12 by means of the previously mentioned suitable tool which engages recess 18. In order to increase the height of the gate 50 the grub screw 16 is screwed into the barrel 12 in the direction of arrow A to thereby push the gate upwardly in the direction of arrow B. In order to lower the gate the grub screw 18 is screwed out of the barrel 12 in the direction of arrow C and the gate 50 is lowered in the direction of arrow D.

The hinge of this invention therefore enables vertical adjustment of the height of a gate by simply screwing the grub screw 16 inwardly or outwardly of the barrel 12. Furthermore, since the grub screws 16 are adjustable in the barrels 12 the grub screws 16 can be adjusted so that each hinge which is used to suspend a gate or door takes the same load. Thus the load of the gate is distributed evenly on all of the hinges.

A major advantage of the hinge of this embodiment is that both ends of the barrel 12 are open and therefore the grub screw 16 can be screw threaded into either end of the barrel 12. Thus, the hinge can be used as either a right or left hand hinge by simply selecting the end of the barrel 12 into which the grub screw 16 is inserted. When a strap portion 14 is used with the barrel 12 the strap portion will extend to either the left or right hand side of the hinge dependent on which end has the grub screw and therefore the hinge of this invention can be used as a right or left hand hinge by simple selecting the end into which the grub screw 16 is located. Thus, when mounting a gate it is not necessary to ensure that either a right or left hand hinge is purchased to correctly mount the gate.

Figure 5:
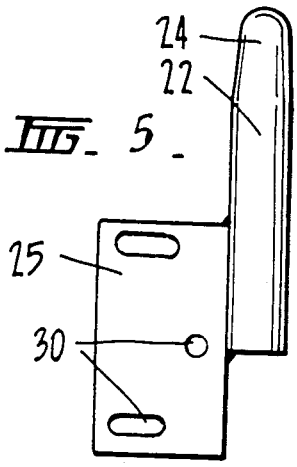
FIG. 5 is a front view of component according to a second embodiment.
Figure 6:
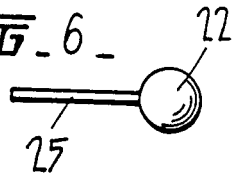
FIG. 6 is a top view of the component of FIG. 5.
Figure 7:
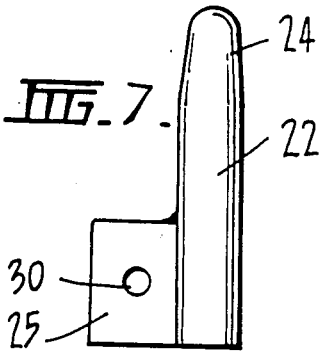

The hinge component shown in FIGS. 1 to 4 which include strap portions 14 and 25 are generally adapted to be coupled to a soft timber post and timber gate by inserting suitable fasteners through the openings 30 and 32 as previously described. In the embodiment of FIGS. 5 and 6 the strap portion 25 is slightly smaller that the strap portion 25 shown in FIG. 4. The strap portion shown in FIGS. 5 and 6 is for use with hard timber in which less fasteners and less support may be required. The pin shown in FIG. 7 includes a small strap 25 which is adapted to be welded to a steel post. In this embodiment the strap 25 is welded to the post and a suitable fastener can be inserted through the single opening 30 in the strap 25. It should be noted that the strap portion 25 extends from the central portion of the pin 22 in all of these embodiments so the pin can be reversed to form a left or right hand hinge.

Figure 8:
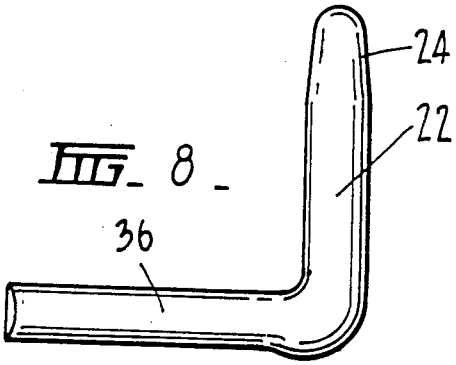
FIGS. 7 to 11 are views of components similar to the component of FIGS. 4 and 5.
Figure 9:
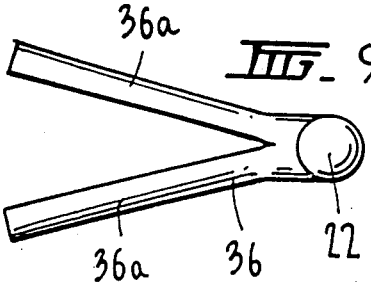

FIGS. 8 and 9 show a pin 22 which has a head 24 similar to the embodiments of FIGS. 4 to 7. However, in the embodiments of FIGS. 8 and 9 the pin has a right angled portion 36 which is integral with the pin 22 and is formed from the same material as the pin 22. The right angle section 36 is flattened and is then split in half and separated as shown in FIG. 9 to form two portions 36*a*. The pin of the embodiments of FIGS. 8 and 9 is adapted to be located between two adjacent courses in brick work when a brick wall or the like is being erected. The portions 36 are simply embedded in mortar between the two courses of bricks and the pin 22 is therefore secured to a brick wall or the like.

Figure 10:
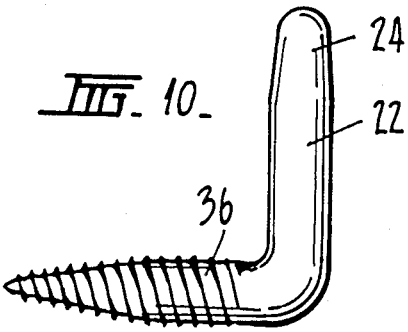
Figure 11:
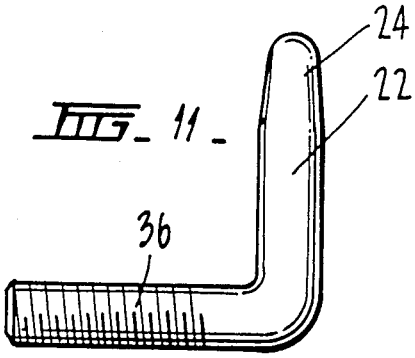

FIGS. 10 and 11 show embodiments of the pin 22 in which the right angle portion 36 is not split but is provided with screw threads which are adapted, in the case of FIG. 10 to be screw threaded into a wooden post and in the case of FIG. 11 to be screw threaded into existing brick work. Horizontal adjustment of the pin can be obtained by simply screwing the pin further into the post or brick work or by unscrewing the pin outwardly of the post or brick work.

FIGS. 2 and 3 which show the barrel portion 12 according to one embodiment which includes the strap 14. In the embodiment in which the strap 14 is used, the barrel 12 is preferably formed by simply rolling the end of the strap 12 as best seen in FIG. 3 to form the barrel 12. The internal diameter of the barrel 12 is then screw threaded by a suitable threading tool. Thus the barrel portion 12 can be located at the end of the strap portion 14 without the need for welding.

The barrel shown in FIGS. 2 and 3 is preferably formed by stamping the strap portion 14 on a stamping machine (not shown), indexing the stamped strap to a rolling means (not shown) which rolls the end of the strap to form the barrel 12, screwing the internal surface of the barrel 12 to provide the screw threads for engagement with the grub screw 16. The holes 32 may be formed in the strap at an intermediate step between the stamping of the strap 14 and the rolling of the end of the strap 14 to form the barrel 12.

FIG. 12 shows an embodiment in which the barrel 12 is in the form of a piece of tube which has an internally threaded surface. This embodiment is adapted for use with metal gates and is simply welded directly to a metal frame portion of the gate. FIG. 16 shows a weather seal which has a top portion 38 and a stem 46. The stem 46 can be of the same shape as the recess 18 or could be of a different shape and is receivable in the recess 18. The weather seal 39 simply sits on the top of the grub screw 16 and if the grub 16 is screw threaded all of the way into the barrel portion 12 the top 38 of the weather seal 39 simply sits on the top of the barrel 12 and prevents water from accumulating in the barrel 12 above the grub screw 16.

The barrel 12 can include an opening (not shown) through which grease can be inserted which surrounds the pin 22 and provides for smooth relative movement between the barrel 12 and the pin 22.

With reference to FIGS. 17 to 22 a hinge is shown which is similar to that described with reference to the earlier figures except that a further component has been added which allows adjustment of the hinge to compensate for any drop of the gate or wind or twist of the gate. In this regard drop of the gate refers to the fact that the gates actually drop so that the free end of the gate is lower than the hinged end of the gate. Drop may occur if the posts move in the ground so that the top of the posts are closer together than the bottom of the posts. Wind or twist occurs when the two gates or posts are not vertically aligned so that the gates tend to be inclined with respect to the vertical rather than perfectly vertical.

Figure 18:
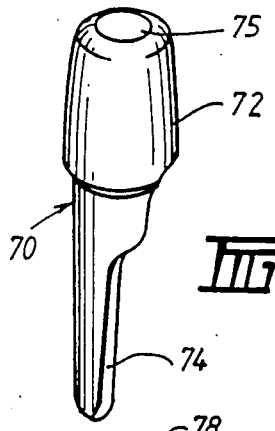
FIGS. 18, 19 and 20 are views of components of FIG. 17.
Figure 17:
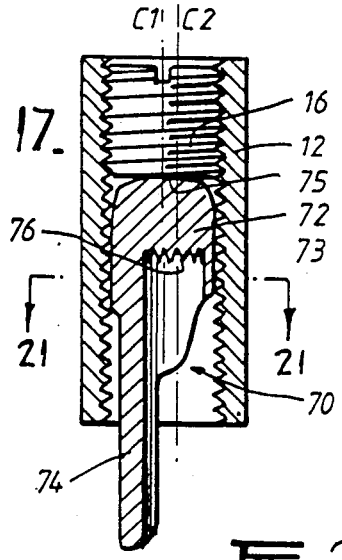
FIG. 17 is a cross-sectional view through another embodiment of the invention.
Figure 19:
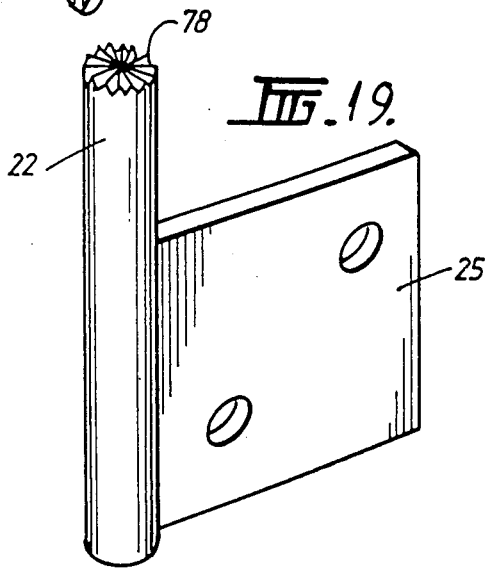
Figure 20:
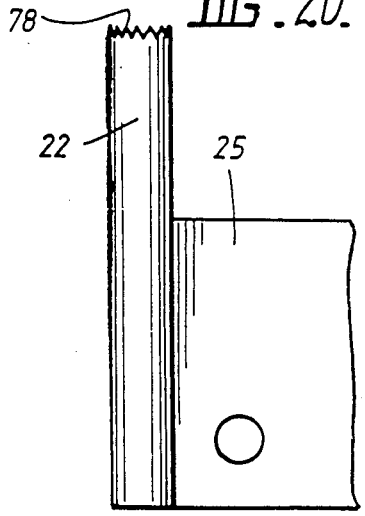

The hinge shown in FIGS. 17 to 22 is generally the same as that shown in the earlier embodiments and can be adjusted with respect to height in precisely the same manner as the earlier embodiments. However, the hinge shown in FIG. 17 includes an intermediate element 70 between the grub screw 16 and the pin 22. The intermediate element 70, as best seen in FIGS. 17 and 18, comprises a tapered head portion 72 which has a bore 73 and a suspending pin supporting skirt 74 which extends part way about the circumference of the pin 22 when the hinge is assembled. In this regard the inside surface of the bore 73 and skirt 74 is contoured to match the contour of the pin 22. As is also shown in FIG. 17 the internal top surface 74 of the bores 73 includes ratchet like projections and grooves 76 which match corresponding projections and grooves 78 formed on the top of the pin 22. The purpose of the projections and grooves 76 and 78 is to lock the intermediate element 70 to the pin 22 when the hinge is assembled. Alternatively the pin 22 and head 72 could be tapped and a screw could be used to lock the pin 22 to the element 70 or the pin could be splined and mesh with corresponding splines in the head 72. In a further embodiment the bore 73 in the head and the pin 22 could be polygonal, such as hexagonal to thereby lock the pin 22 and element 70 together.

In order to assemble the hinge the barrel portion 12 is coupled to a gate in the same manner as earlier embodiments and the pin 22 is coupled to a post in the same manner as described in the earlier embodiments. The intermediate elements 70 may then be slipped over the pin 22 so that the projections and grooves 76 engage the projections and grooves 78 to lock the intermediate element 70 in a desired position on the pin 22. The pin 22 and intermediate element 70 may then be inserted into the barrel portion 12 so that the top of the head 72 engages the bottom of the grub screw 17. Vertical alignment of the hinge may be accomplished by screwing the grub screw 16 into or out of the barrel portion 12. When a gate (not shown) is opened or closed the pin 22 and intermediate element and are fixed together by the projections and grooves 76 and 78 and rotate as a single unit in the barrel 12.

As is also clear from FIG. 17 the centre line of the hollow opening of the head 72, which is designated by the reference Cl is not concentric with the centre line C2 of the barrel 12. The thickness of the head 72 in the vicinity of the skirt 74 is much thicker than the thickness of the head 72 on the opposite side of the intermediate element 70. In this regard the bore 73 in the intermediate element 70 is not centrally located but is eccentrically located with respect to the head 72.

When the hinge is assembled and the gate is suspended by hinges shown in this embodiment, the hinge can be adjusted to compensate for any drop of the gate or twist or wind of the gate by suitably supporting the gate and unscrewing the grub screw 16 from the barrel 12. When the grub screw 16 has been removed from the barrel 12, the intermediate element 70 may be drawn upwardly by a suitable tool (not shown) by inserting the tool into a hole or the like 75 formed in the top of the head 72. Alternatively the grub screw 16 could merely be loosened and the element 70 pushed up by gripping and pushing upwards skirt 74 which extends below barrel 12. Once the intermediate element 70 has been lifted so that the projections 76 are clear of the projections 78, the intermediate element 70 may be rotated relative to the barrel 12 and the pin 22 and then relocated so that the projections 76 engage the projections 78 to lock the intermediate element 70 in the new position relative to the pin 22 and barrel 12. The grub screw may be then adjusted to the desired height.

Figure 21:
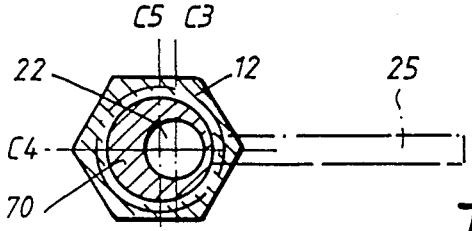
FIG. 21 is a view along the line 21—21 of FIG. 17.
Figure 22:
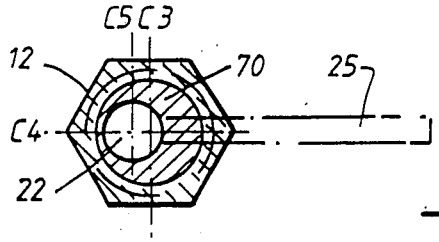
FIG. 22 is a view similar to FIG. 21.

As is shown in FIGS. 21 and 22, location of the intermediate element 70 relative to the pin 22 and the barrel 12 effectively causes the pin, when reinserted into the bore 73, to take up a new position in the barrel 12 and to effectively shift the pivot point of the hinge in accordance with the movement of the intermediate element 70. As is clear from FIGS. 21 and 22 movement of the intermediate element 70 can shift the point of the hinge from the intersection of the lines C3 and C4 to the intersection of the lines C5 and C4. This effectively shifts the pivot point to the left in FIGS. 21 and 22 by a distance equal to twice the distance between the central axis of the bore 73 and the central axis of the barrel 12 when the intermediate element 70 is rotated 180°. This 180° rotation of the intermediate element 70 can be used to compensate for any drop of the gate since it effectively shifts the pivot point of a hinge inwardly or outwardly with respect to a support post in the vertical plane containing the gates.

To compensate for any twist or wind of the gates the intermediate element 70 can be rotated from the position shown in FIG. 21 by an amount less than 180° or an amount greater than 180°. The greatest amount of adjustment will occur when the intermediate element 70 is rotated 90° as this will shift the pivot point of the pin upwardly or downwardly from the line C4 in FIGS. 21 and 22 depending on the direction of rotation. This adjustment effectively moves the pivot point of the pin in a direction perpendicular to the plane containing the gates to compensate for any wind or twist of the gates.

Therefore, by suitable adjustment of the intermediate element 70 and the grub screw 16 a gate can be correctly mounted in a vertical plane and should the gate drop or twist due to movement of a post or posts or fatigue of fastening elements which hold the hinge to the gate or post, the intermediate element 70 and grub screw 16 can be suitably adjusted to compensate for any misalignment caused by the drop or twist or wind of the gate.

In alternate embodiments the skirt 74 could be dispensed with. Furthermore, the grub screw could be provided with the eccentric bore and act as a element which provides both height adjustment and adjustment in the direction transverse to the plane of the gate.

Since modification within the spirit and scope of the invention may readily be effected by persons skilled within the art, it is to be understood that this invention is not limited to the particular embodiment described by way of example hereinabove.

The claims defining the invention are as follows:

1. A hinge having a barrel portion, a pin for location in said barrel portion and a pin locating member coupleable to said barrel portion for movement in the longitudinal direction of said barrel portion relative to said barrel portion for locating said pin in the barrel portion so that said pin is able to rotate in said barrel portion, said barrel portion being open at both ends and having an internal screw thread at least at both ends, said pin locating member having a screw threaded surface for engagement with the internal screw thread of said barrel portion, said pin locating member being coupleable to the barrel portion by engaging the screw threaded surface of the pin locating member with said internal screw threaded surface and being movable in said longitudinal direction by being screwed into and outwardly of the barrel portion, said hinge being able to adjust the position of articles with which it is used by screwing the said pin locating member into or outwardly of said barrel portion so that the location of said pin is altered relative to said barrel in the longitudinal direction of the barrel to thereby adjust the relative height of the article to which the pin can be coupled relative to the height of the article to which the barrel is coupled and said pin locating member being screwable into either end of said barrel portion so that the hinge can be used as either a right hand or left hand hinge by screwing the pin locating member into the appropriate end of the barrel and inserting the pin into the other end of the barrel.

2. A hinge having a barrel, a pin for location in said barrel, said hinge having an adjustment element in said barrel for receiving said pin, said adjustment element being movable relative to said barrel to adjust the location of the pin in the barrel in a direction transverse to the longitudinal axis of the pin and barrel, wherein said adjustment element has a bore being eccentric with respect to the longitudinal axis of said adjustment element so that said adjustment element can be rotated in the barrel relative to the pin and barrel to alter the position of the bore and therefore the pin in said barrel, a releasable locking means on the pin and the adjustment element for locking the adjustment element in a desired position on said pin.

3. A hinge according to claim 2, wherein the locking means comprises projections and grooves on a top portion of said pin and complementary projections and grooves on a roof portion of said bore.

4. A hinge according to claim 1, wherein said pin locating member has a bearing surface for receiving said pin.

5. A hinge according to claim 2, wherein said adjustment element is an intermediate element disposed between a bearing surface in the barrel and the pin.

6. A hinge according to claim 5, wherein the bearing surface is provided on a pin locating member for providing height adjustment of the hinge.

7. A hinge according to claim 1 wherein an intermediate element is disposed between said pin and said pin locating member, said intermediate element allowing adjustment of the pin in the barrel in a direction transverse to the longitudinal axis of the pin and barrel.

8. A hinge having a barrel element and a pin element adapted to be received within said barrel element, said barrel having a central opening, stop means closing one end of said central opening, said pin element having a diameter less than that of said central opening; an adjustment element having a head portion of a diameter to rotatably and closely fit in said central opening and seat against said stop means, said adjustment means having a socket of a size and shape to seat the end of said pin element, said socket being eccentric of the central axis of said adjustment means; the end of said pin and said socket having interengaging means for detachably securing said adjustment means to said pin for simultaneous unitary rotation thereof.

9. The hinge according to claim 8 wherein said adjustment element has an elongated skirt partially surrounding said pin and projecting axially beyond the end of said barrel opposite from said closure means whereby when said pin is moved away from said socket said adjustment element can be rotated relative to said pin to adjust the direction of eccentricity of said hinge.

* * * * *

UNITED STATES PATENT AND TRADEMARK OFFICE

CERTIFICATE OF CORRECTION

PATENT NO. : 4,748,717

DATED : June 7, 1988

INVENTOR(S) : DAVID OSBORNE

It is certified that error appears in the above-identified patent and that said Letters Patent is hereby corrected as shown below:

Column 4, line 10:
"24" should be --14--.
Column 4, line 26:
"18" should be --16--.
Column 4, line 51:
"simple" should be --simply--
Column 7, line 55:
"a element" should be --an element--.
Column 8, line 31:
After "bore" insert --for receiving said pin, said bore--.

Signed and Sealed this

Twenty-ninth Day of August, 1989

*Attest:*

DONALD J. QUIGG

*Attesting Officer*

*Commissioner of Patents and Trademarks*